US008217737B2

(12) United States Patent
Reddy et al.

(10) Patent No.: US 8,217,737 B2
(45) Date of Patent: Jul. 10, 2012

(54) COUPLER FOR TUNING RESONANT CAVITIES

(75) Inventors: Raja K Reddy, Cheshire, CT (US); Peter A Casey, Clinton, CT (US)

(73) Assignee: Alcatel Lucent, Paris (FR)

( * ) Notice: Subject to any disclaimer, the term of this patent is extended or adjusted under 35 U.S.C. 154(b) by 433 days.

(21) Appl. No.: 12/609,947

(22) Filed: Oct. 30, 2009

(65) Prior Publication Data

US 2011/0102112 A1 May 5, 2011

(51) Int. Cl.
*H01P 1/20* (2006.01)
*H01P 7/10* (2006.01)

(52) U.S. Cl. ..... 333/202; 333/209; 333/235

(58) Field of Classification Search ..... 333/202, 333/209, 207, 212, 230, 219.1, 224, 235
See application file for complete search history.

(56) References Cited

U.S. PATENT DOCUMENTS

| | | | | |
|---|---|---|---|---|
| 5,070,313 | A * | 12/1991 | Gladh et al. | 333/202 |
| 5,777,534 | A * | 7/1998 | Harrison | 333/202 |
| 5,805,033 | A * | 9/1998 | Liang et al. | 333/202 |
| 6,304,160 | B1 * | 10/2001 | Loi et al. | 333/212 |
| 2004/0051602 | A1 | 3/2004 | Pance et al. | |
| 2008/0272861 | A1 | 11/2008 | Henault et al. | |

OTHER PUBLICATIONS

International Search Report dated Feb. 4, 2011 for corresponding PCT Application No. PCT/US2010/053746.

* cited by examiner

*Primary Examiner* — Seungsook Ham
(74) *Attorney, Agent, or Firm* — Kramer & Amado P.C.

(57) ABSTRACT

Various exemplary embodiments relate to an improved coupler for resonant cavities and dielectric resonators. The coupler may permit accurate tuning of electromagnetic signals within desired frequency ranges. The coupler may be secured to a movable tuning device by a plurality of securing members. Each securing member may be separate, having no contact with any other securing member.

20 Claims, 6 Drawing Sheets

COUPLER FOR TUNING RESONANT CAVITIES

TECHNICAL FIELD

Embodiments disclosed herein relate generally to a coupler for tuning frequency ranges between resonant cavities, such as dielectric resonators.

BACKGROUND

A resonant cavity is a hollow volume that stores standing waves. In an electrical context, at least one conductive wall defines an outer surface of the resonant cavity. A probe in the middle of the volume may guide the waves in a desired manner. This probe, also known, as a "puck," may be metallic, ceramic, or made of other materials. The paragraphs below describe a resonant cavity that may include a ceramic puck, often called a "dielectric resonator."

A dielectric resonator is an electronic component that exhibits resonance for a narrow range of frequencies, generally in the microwave band. Resonators are used in, for example, radio frequency communication equipment. In order to achieve the desired operation, many resonators include a "puck" disposed in a central location within a cavity that has a large dielectric constant and a low dissipation factor.

The combination of the puck and the cavity imposes boundary conditions upon electromagnetic radiation within the cavity. The cavity has at least one conductive wall, which may be fabricated from a metallic material. A longitudinal axis of the puck may be disposed substantially perpendicular to an electromagnetic field within the cavity, thereby controlling resonation of the electromagnetic field.

When the puck is made of a dielectric material, such as ceramic, the cavity may resonate in the transverse electric (TE) mode. Thus, there may be no electric field in the direction of propagation of the electromagnetic field. While many TE modes may be used, dielectric resonators may use the TE011 mode for applications involving microwave frequencies. Using the TE011 mode as an exemplary case, the electric field will reach a maximum within the puck, have an azimuthal component along a central axis of the puck, generally decrease in the cavity away from the puck, and vanish entirely along any conductive cavity wall. The magnetic field will also reach a maximum within the puck, but will lack an azimuthal component.

When combining more than one dielectric resonator, a designer will need to couple electromagnetic energy from the first cavity to the second cavity. Such coupling may be difficult if the first cavity is distant from the second cavity. Coupling may also require the careful fabrication of apertures connecting the first and second cavities. These apertures may be tuned in a factory to compensate for manufacturing tolerances.

Despite such tuning, it may be difficult to build a filter that couples multiple cavities or dielectric resonators together to define a desired frequency range. Conventional attempts to provide specified spectra had been both impractical and expensive. These tuners have used many parts and tedious techniques that make it difficult to adjust coupling between resonant cavities or dielectric resonators.

Accordingly, there is a need for an improved coupler that provides tuning over a wide range of frequencies. More particularly, there is a need for a coupler that can be used in wide bandwidth filters. There is also a need for a cost effective technique that couples high dielectric resonators.

SUMMARY

In light of the present need for improved tuning of resonant cavities and dielectric resonators, a brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

In various exemplary embodiments, a system for enhanced tuning of dielectric resonators may comprise a first dielectric resonator that produces electromagnetic signals within a first range of frequencies; a second dielectric resonator that produces electromagnetic signals within a second range of frequencies; a movable tuning device disposed in an aperture between the first dielectric resonator and the second dielectric resonator; and a coupler secured to the movable tuning device. The coupler may transfer electromagnetic signals between the first dielectric resonator and the first dielectric resonator and comprise a plurality of securing members that extend radially inwardly toward the movable tuning device. Each of the securing members may be spaced apart from any other securing member.

In addition, in various exemplary embodiments, a system for enhanced tuning of electromagnetic signals in resonant cavities may comprise a movable tuning device disposed in an aperture between a first resonant cavity and a second resonant cavity, wherein a vertical axis of the movable tuning device is parallel to respective vertical axes of the first resonant cavity and the second resonant cavity; and a coupler secured to the movable tuning device. The coupler may transfer electromagnetic signals between the first resonant cavity and the second resonant cavity and comprise a plurality of securing members that extend radially inwardly toward the movable tuning device. Each of the securing members may be spaced apart from any other securing member.

Accordingly, various exemplary embodiments provide an improved way to couple electromagnetic energy between resonant cavities or dielectric resonators. These embodiments may allow precise tuning of frequencies to a desired spectral range. These embodiments may also allow a designer to obtain a wider tuning range than conventional tuning techniques.

BRIEF DESCRIPTION OF THE DRAWINGS

In order to better understand various exemplary embodiments, reference is made to the accompanying drawings, wherein.

DETAILED DESCRIPTION

Figure 1:
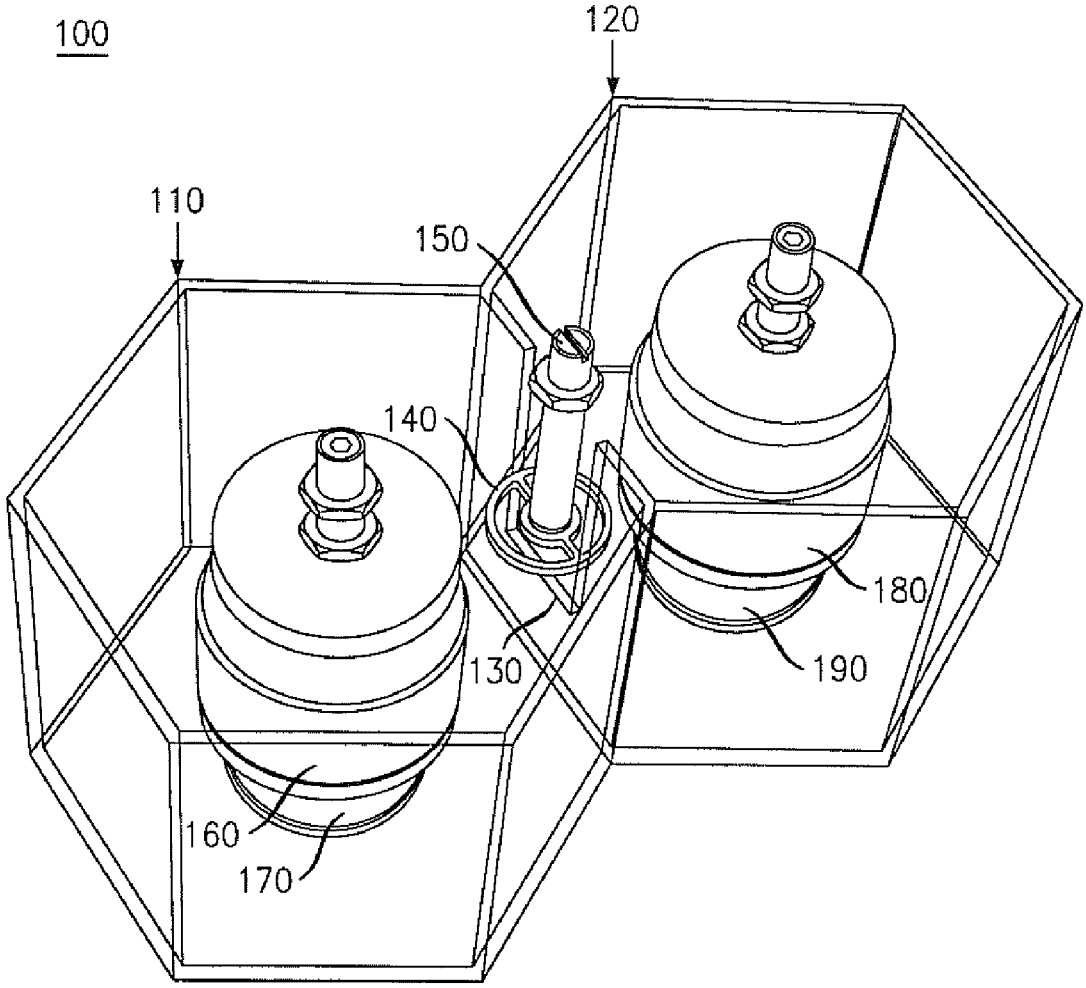
FIG. 1 shows a perspective view of an exemplary dielectric filter including an exemplary coupler.

Referring now to the drawings, in which like numerals refer to like components or steps, there are disclosed broad aspects of various exemplary embodiments.

FIG. 1 is a perspective view of an exemplary dielectric filter 100. As shown in FIG. 1, filter 100 comprises a first dielectric resonator 110 and a second dielectric resonator 120. An aperture 130 connects the first dielectric resonator 110 to the second dielectric resonator 120. While exemplary filter 100 has only two dielectric resonators, one of ordinary skill in the art may design filter 100 to have an arbitrary number of dielectric resonators, depending upon the applicable environment for the filter.

FIG. 1 depicts first dielectric resonator 110 and second dielectric resonator 120 as hexagonal prisms. Thus, first dielectric resonator 110 and second dielectric resonator 120 are both semiregular polyhedra having eight faces. For hexagonal prisms, two of the eight faces are hexagonal while six of the eight faces are rectangular. It should be apparent, however, that one of ordinary skill in the art could design filter 100 to use dielectric resonators having other shapes. Alternative forms include, for example, spheres, cylinders, and cubes. Dielectric resonators may also have polyhedral shapes other than hexagonal prisms.

In each embodiment, at least one conductive wall may totally enclose the volume of first dielectric resonator 110 and second dielectric resonator 120. The at least one conductive wall may be metallic. Thus, an appropriate stimulus could cause the enclosed volume to resonate, allowing first dielectric resonator 110 and second dielectric resonator 120 to become sources of electromagnetic oscillations. Aperture 130 would function as a tuner for these oscillations, thereby permitting filter 100 to generate electromagnetic signals within an appropriate frequency range.

The need for tuning is particularly acute when operation of the dielectric resonator should occur within a predefined range of frequencies. High power dielectric resonators may be widely used in applications, such as wireless broadcasting of video, audio, and other multimedia from a tower to a receiver. In current implementations in the United States, such technologies may transmit signals over a frequency spectrum of 716-722 MHz. Thus, a coupler 140 between first dielectric resonator 110 and second dielectric resonator 120 may provide accurate tuning within this spectral range. Exemplary couplers for use in filter 100 are described in further detail below in connection with FIGS. 4-9.

Figure 2:
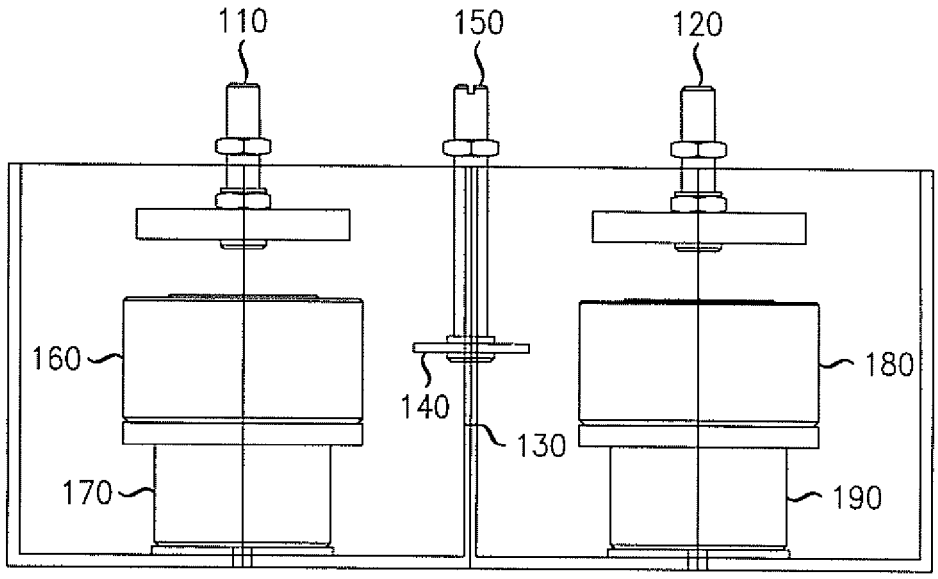
FIG. 2 shows a side view of an exemplary dielectric filter including an exemplary coupler.

FIG. 2 shows a side view of exemplary dielectric filter 100. As detailed above, dielectric filter 100 may comprise a first dielectric resonator 110, depicted on the left side, and a second dielectric resonator 120, depicted on the right side. An aperture 130 may couple electromagnetic signals between first dielectric resonator 110 and second dielectric resonator 120. A movable tuning device 150 located within aperture 130 may move up and down along a vertical axis. This vertical axis may be parallel to respective vertical axes in both first dielectric resonator 110 and a second dielectric resonator 120. Movable tuning device 150 may be a screw or rod, for example. As illustrated in FIG. 2, tuning device 150 may include a standard head, such that a tuning tool (e.g., a screwdriver) may be used to rotate tuning device 150, thereby moving tuning device 150 vertically within the filter 100.

Coupler 140 may be attached or otherwise coupled to the end of tuning device 150, such that coupler 140 also moves vertically within the filter. An exemplary arrangement for attaching coupler 140 to tuning device 150 is described in further detail below in connection with FIG. 5.

First dielectric resonator 110 may comprise a puck 160 and a support 170. Second dielectric resonator 120 may comprise a puck 180 and a support 190. Puck 160 and puck 180 may define horizontal axes that are perpendicular to the vertical axis of movable tuning device 150.

Figure 3:
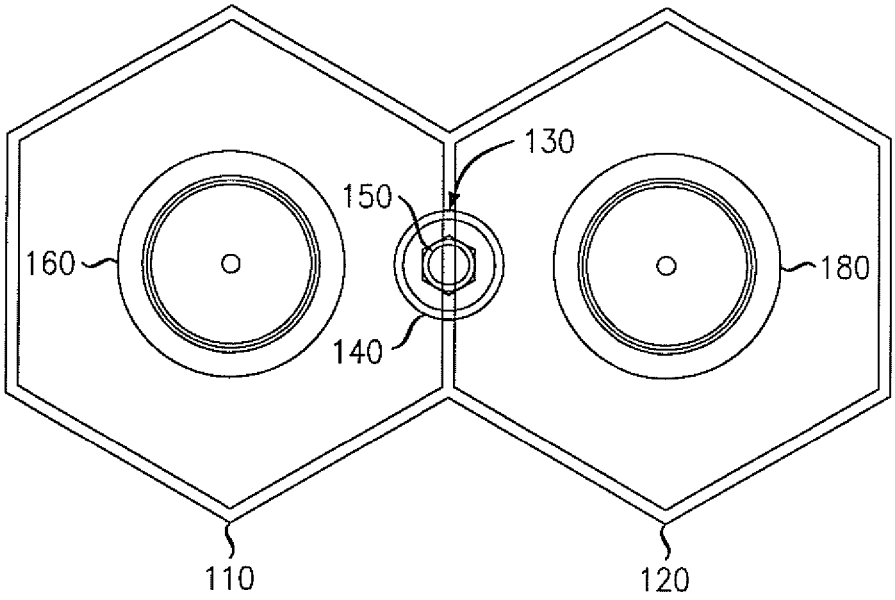
FIG. 3 shows a top view of an exemplary dielectric filter including an exemplary coupler.

FIG. 3 shows a top view of exemplary dielectric filter 100. As detailed above, dielectric filter 100 may comprise a first dielectric resonator 110, on the left, and a second dielectric resonator 120, on the right. An aperture 130 may couple electromagnetic signals between first dielectric resonator 110 and second dielectric resonator 120. A coupler 140 located within aperture 130 may tune the electromagnetic signals to define a spectral range of desired frequencies, such as 716-722 MHz. Coupler 140 may be secured to movable tuning device 150. Various ways to secure coupler 140 to movable tuning device 150 are depicted in FIG. 4 through FIG. 8.

Figure 4:
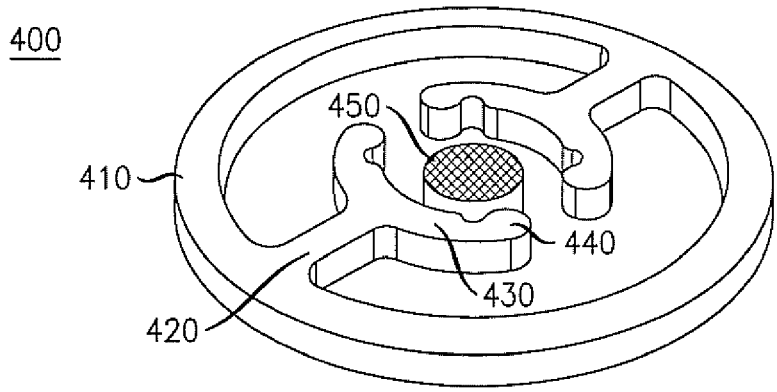
FIG. 4 shows a first embodiment of an exemplary coupler.

FIG. 4 shows a first embodiment of an exemplary coupler 400. Coupler 400 may comprise an outer member 410 that is concentric relative to the movable tuning device 450, wherein a diameter of outer member 410 is proportional to a tuning range for the electromagnetic signals. Outer member 410 may be toroidal in shape, having an annular form relative to a central axis. Outer member 410 may have a circular or rectangular cross-section.

A pair of securing members 420 may extend radially inwardly from outer member 410 toward movable tuning device 450. The securing members 420 may be opposite to each other and are spaced apart from one another. Because securing members 420 are entirely separate, having no physical contact, the size of outer member 410 may determine the overall coupling behavior of coupler 400.

Clamping members 430 hold the securing members 420 against the movable tuning device. Each clamping member 430 may comprise a pair of prongs 440. The prongs 440 secure the coupler 400 to the movable tuning device 450, but prongs 440 of different securing members do not touch. Consequently, only the diameter of toroidal member 410 will influence the transfer of electromagnetic energy across coupler 400.

Figure 5:
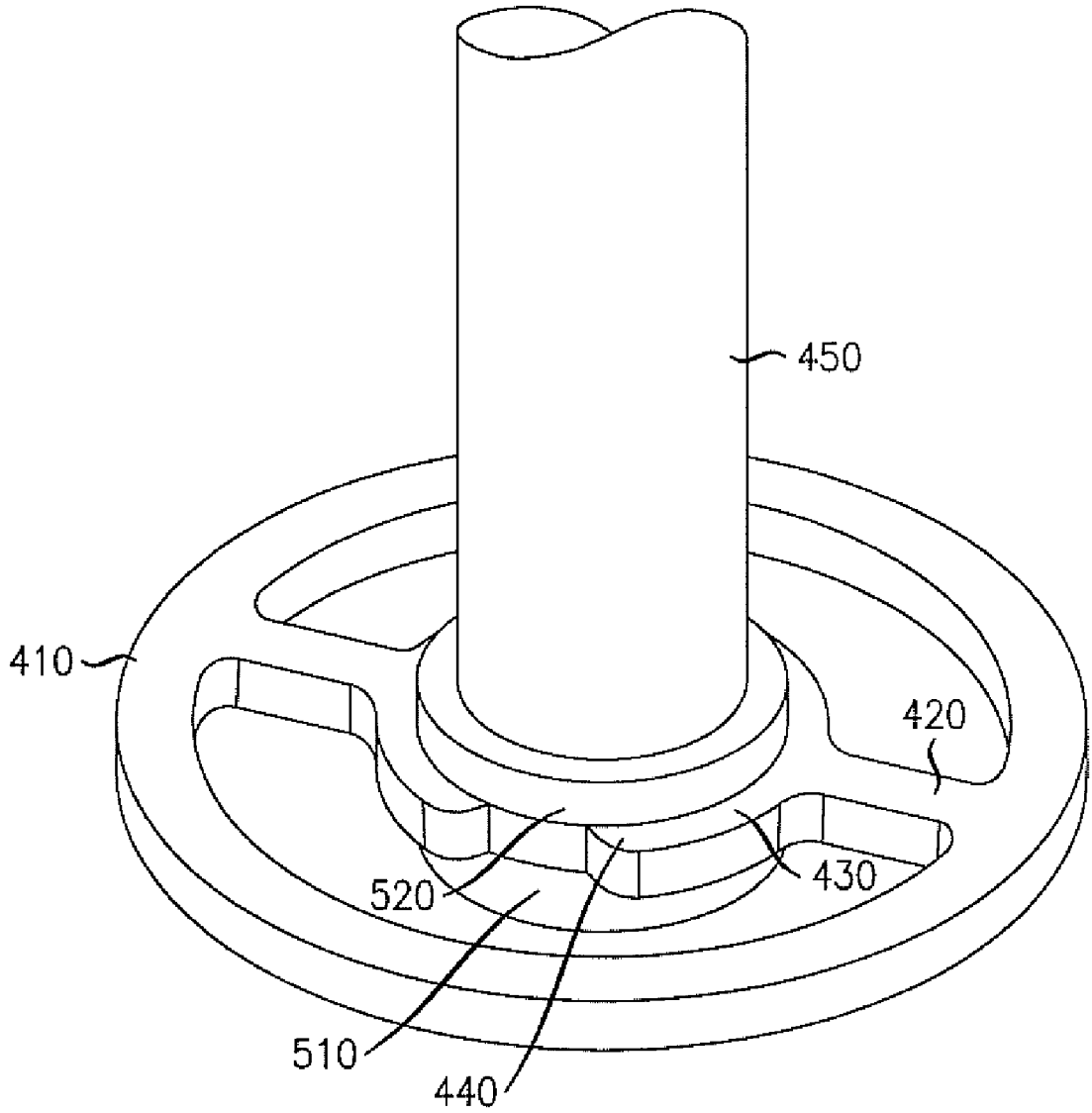
FIG. 5 depicts a detailed view of an exemplary relationship between the coupler of the first embodiment and a movable tuning device.

FIG. 5 depicts a detailed view of an exemplary relationship between coupler 400 and movable tuning device 450. Coupler 400 may be placed on movable tuning device 450 by sliding down until coupler 400 reaches stopping member 510. Stopping member 510 may be a screw head, washer, or another appropriate barrier. Holding member 520 may be a disk disposed above coupler 400, maintaining the relative position of coupler 400 on movable tuning device 450. Holding member 520 may be an epoxy disk, wafer, or other item fabricated from a non-conductive material.

Figure 6:
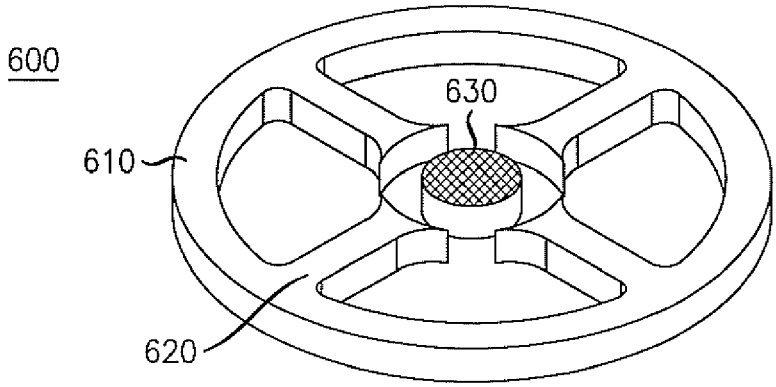
FIG. 6 shows a second embodiment of an exemplary coupler.

FIG. 6 shows a second embodiment of an exemplary coupler 600. Coupler 600 may comprise an outer member 610 that may be concentric relative to a movable tuning device 630, wherein a width of outer member 610 may be proportional to a tuning range for the electromagnetic signals. A quartet of securing members 620 may extend radially inwardly toward the movable tuning device 530. Alternatively, other numbers of securing members 620 may be used. In various exemplary embodiments, the securing members 620 do not touch and may be spaced roughly 90° apart. Alternatively, spacing may be irregular instead of occurring at identical intervals.

Figure 7:
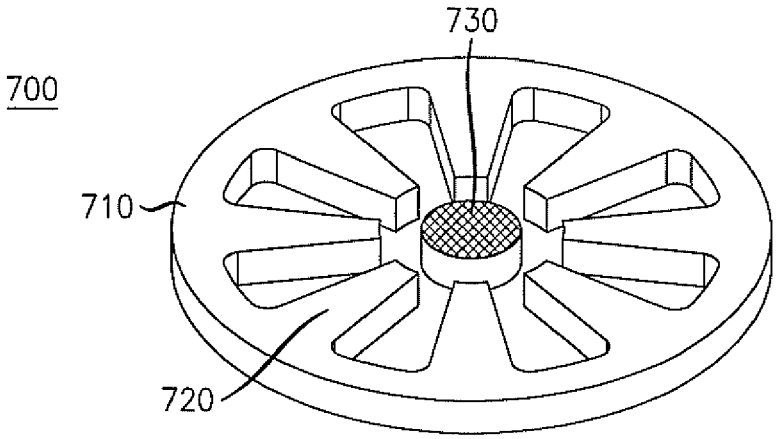
FIG. 7 shows a third embodiment of an exemplary coupler.

FIG. 7 shows a third embodiment of an exemplary coupler 700. Coupler 700 may comprise an outer member 710 that may be concentric relative to movable tuning device 730, wherein a diameter of outer member 710 may be proportional to a tuning range for the electromagnetic signals. An octet of securing members 720 may extend radially inwardly toward movable tuning device 730. Alternatively, other numbers of securing members 720 may be used. In various exemplary embodiments, the securing members 720 do not touch and may be spaced roughly 45° apart. Alternatively, spacing may be irregular instead of occurring at identical intervals.

Figure 8:
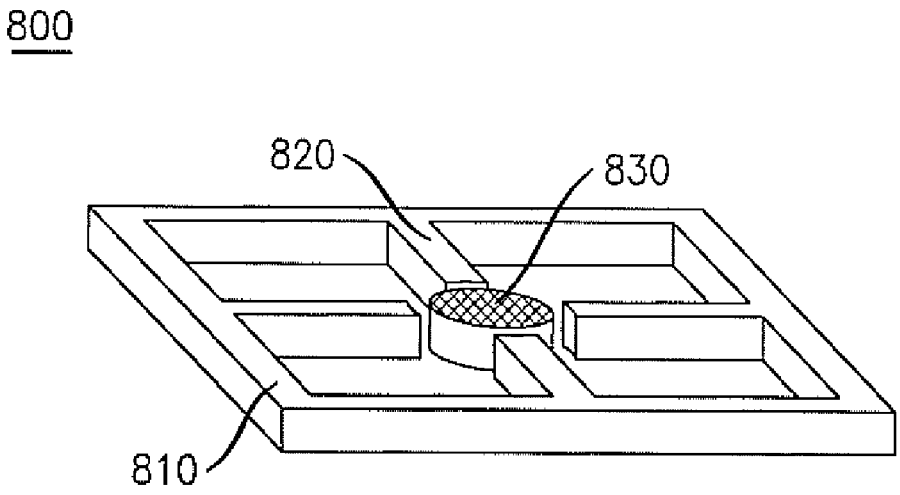
FIG. 8 shows a fourth embodiment of an exemplary coupler.

FIG. 8 shows a fourth embodiment of an exemplary coupler 800. Coupler 800 may comprise an outer member 810 that may be concentric relative to movable tuning device 830, wherein an external surface of outer member 810 may be hexahedral in shape. Outer member 810 may have a square cross-section in order to promote uniform tuning. A quartet of securing members 820 may extend radially inwardly toward movable tuning device 830. Alternatively, other numbers of securing members 820 may be used. In various exemplary embodiments, the securing members 820 do not touch and may be spaced roughly 90° apart. Alternatively, spacing may be irregular instead of occurring at identical intervals.

Figure 9:
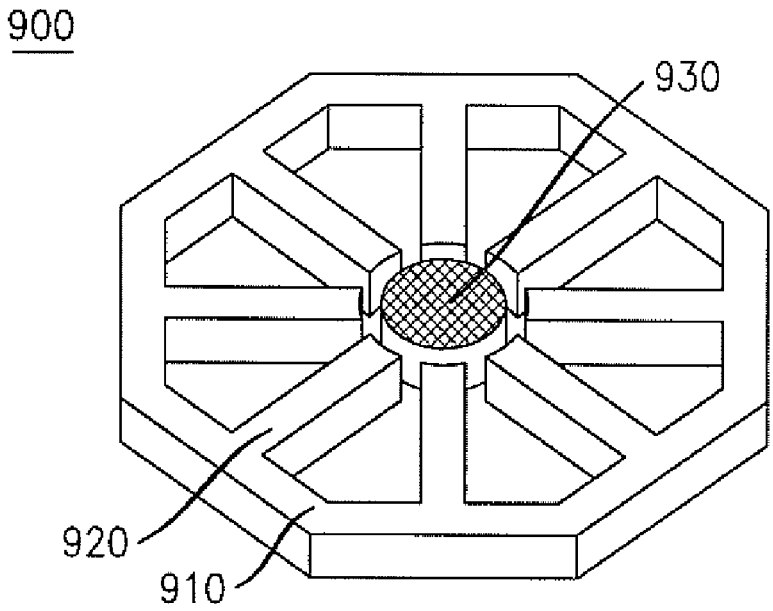
FIG. 9 shows a fifth embodiment of an exemplary coupler.

FIG. 9 shows a fifth embodiment of an exemplary coupler 900. Coupler 900 may comprise an outer member 910 that may be concentric relative to movable tuning device 930, wherein an external surface of outer member 910 may be octagonally-prismatic in shape. An octet of securing members 920 may extend radially inwardly toward movable tuning device 930. Alternatively, other numbers of securing members 920 may be used. In various exemplary embodiments, the securing members 920 do not touch and may be spaced roughly 45° apart. Alternatively, spacing may be irregular instead of occurring at identical intervals. Other polyhedral shapes may be used for outer member 910, depending upon the tuning environment of the aperture containing coupler 900.

It should be apparent that the exemplary embodiments of the coupler described above in connection with FIGS. 4-9 may be combined in a number of ways. For example, the outer members of a particular embodiment may be combined with the securing members of any other embodiment. Other suitable shapes for the outer member of the coupler and the securing members will be apparent to those of skill in the art.

Figure 10:
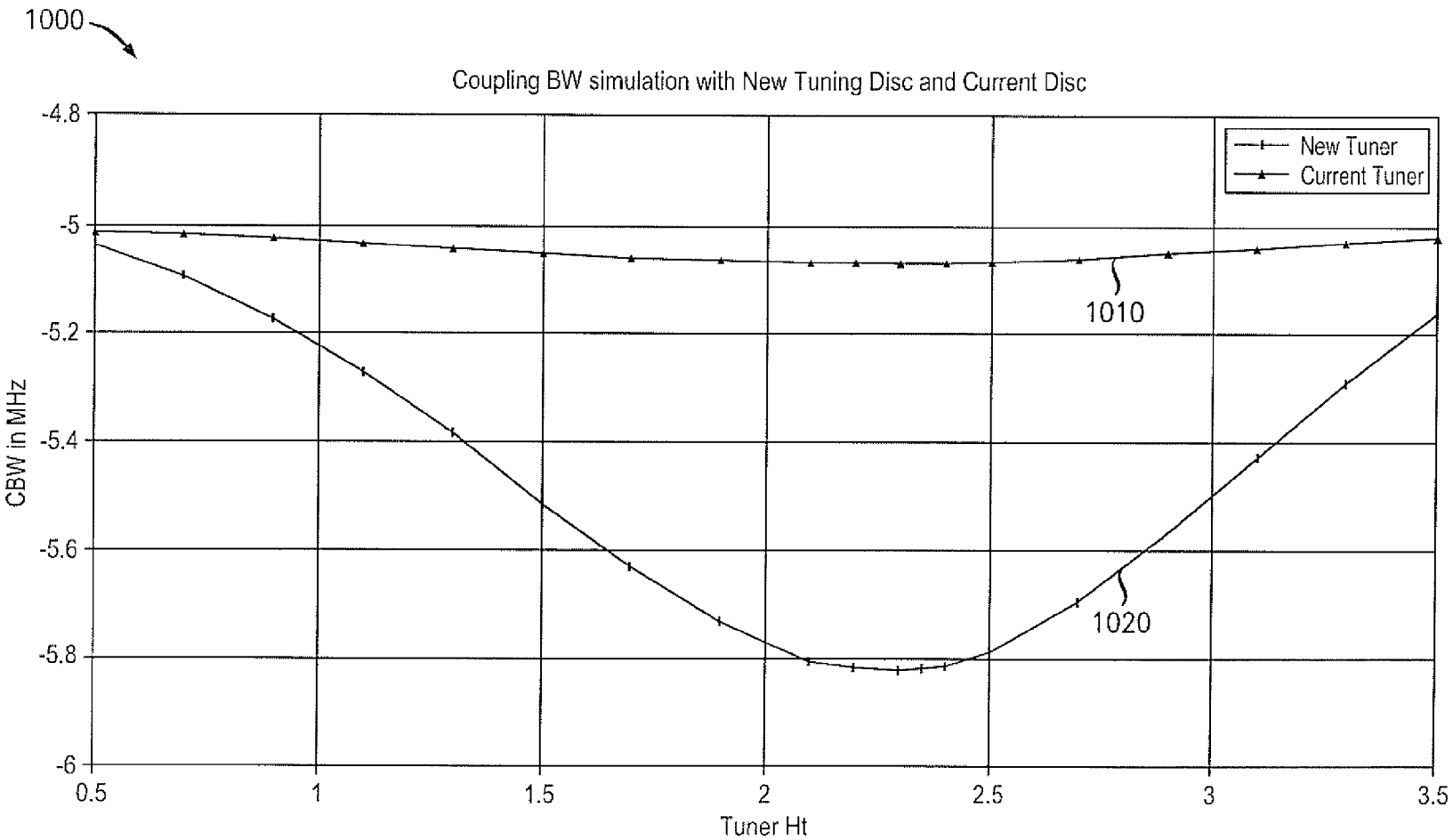
FIG. 10 depicts comparative test results for an exemplary coupler and a conventional aperture tuner.

FIG. 10 depicts comparative test results 1000 for an exemplary coupler and a conventional aperture tuner. In particular, FIG. 10 presents a graph of coupling tunability for a particular frequency range. For test results 1000, the x-axis depicts the distance of a movable tuning device in inches relative to at least one conductive wall of the cavity. The y-axis depicts the coupling bandwidth in MHz.

For a conventional aperture tuner, a tuning range is very narrow. This range may, for example, extend from 5% to 8%, a range that is insufficient for many applications. As shown in FIG. 10, test results 1010 for the conventional tuner reflect only a slight variation from a value of roughly 5 MHz.

For an exemplary tuner using a coupler, as described above in FIG. 4 through FIG. 9, test results 1020 may be greatly improved compared to test results 1010. Test results 1020 may follow a Gaussian distribution, a bell-shaped curve that reaches a level of roughly 5.8 MHz at a tuner height of about 2.3 inches. This distribution may result in 25% tunability in the coupling band, thereby providing the flexibility to use resonant cavities and dielectric resonators in new applications.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A system for enhanced tuning of dielectric resonators, the system comprising:
   - a first dielectric resonator that produces electromagnetic signals within a first range of frequencies;
   - a second dielectric resonator that produces electromagnetic signals within a second range of frequencies;
   - a movable tuning device disposed in an aperture between the first dielectric resonator and the second dielectric resonator; and
   - a coupler secured to the movable tuning device, wherein the coupler transfers electromagnetic signals between the first dielectric resonator and the first dielectric resonator and comprises a plurality of securing members that extend radially inwardly toward the movable tuning device to secure the coupler to the movable tuning device, each of the securing members being spaced apart from all other securing members.

2. The system of claim 1, wherein the coupler further comprises:
   - an outer member that is concentric relative to the movable tuning device, wherein a width of the outer member is proportional to a tuning range for the electromagnetic signals in the aperture.

3. The system of claim 2, wherein the coupler further comprises:
   - clamping members that hold the plurality of securing members against the movable tuning device.

4. The system of claim 3, wherein each clamping member comprises a pair of prongs, wherein the pair of prongs secures the coupler to the movable tuning device.

5. The system of claim 2, wherein the plurality of securing members comprise at least four securing members that extend radially inwardly from the outer member toward the movable tuning device.

6. The system of claim 2, wherein the plurality of non-contiguous securing members comprise at least eight securing members that extend radially inwardly from the outer member toward the movable tuning device.

7. The system of claim 1, wherein the coupler further comprises:
   - an outer member that is concentric relative to the movable tuning device, wherein an external surface of the outer member is hexahedral in shape.

8. The system of claim 7, wherein the plurality of securing members comprise at least four securing members that extend inwardly from the outer member toward the movable tuning device.

9. The system of claim 1, wherein the coupler further comprises:
   - an outer member that is concentric relative to the movable tuning device, wherein an external surface of the outer member is octagonally prismatic in shape.

10. The system of claim 9, wherein the plurality of securing members comprise at least eight securing members that extend inwardly from the outer member toward the movable tuning device.

11. A system for enhanced tuning of electromagnetic signals in resonant cavities, the system comprising:

a movable tuning device for placement in an aperture between a first resonant cavity and a second resonant cavity, wherein a vertical axis of the movable tuning device is parallel to respective vertical axes of the first resonant cavity and the second resonant cavity; and a coupler secured to the movable tuning device, wherein the coupler transfers electromagnetic signals between the first resonant cavity and the second resonant cavity and comprises a plurality of securing members that extend radially inwardly toward the movable tuning device to secure the coupler to the movable tuning device, each of the securing members being spaced apart from all other securing members.

12. The system of claim 11, wherein the coupler further comprises:

an outer member that is concentric relative to the movable tuning device, wherein a width of the outer member is proportional to a tuning range for the electromagnetic signals in the aperture.

13. The system of claim 12, wherein the coupler further comprises:

clamping members that hold the plurality of securing members against the movable tuning device.

14. The system of claim 13, wherein each clamping member comprises a pair of prongs, wherein the pair of prongs secures the coupler to the movable tuning device.

15. The system of claim 12, wherein the plurality of securing members comprise at least four securing members that extend radially inwardly from the outer member toward the movable tuning device.

16. The system of claim 12, wherein the plurality of securing members comprise at least eight securing members that extend radially inwardly from the outer member toward the movable tuning device.

17. The system of claim 11, wherein the coupler further comprises:

an outer member that is concentric relative to the movable tuning device, wherein an external surface of the outer member is hexahedral in shape.

18. The system of claim 17, wherein the plurality of securing members comprise at least four securing members that extend inwardly from the outer member toward the movable tuning device.

19. The system of claim 11, wherein the coupler further comprises:

an outer member that is concentric relative to the movable tuning device, wherein an external surface of the outer member is octagonally prismatic in shape.

20. The system of claim 19, wherein the plurality of securing members comprise at least eight securing members that extend inwardly from the outer member toward the movable tuning device.

* * * * *